US005495674A

United States Patent [19]

Taylor, Jr.

[11] Patent Number: 5,495,674

[45] Date of Patent: Mar. 5, 1996

[54] FOLDING KNIFE WITH MOVEABLE PIVOT AXIS

[75] Inventor: William J. Taylor, Jr., Marietta, Ga.

[73] Assignee: Camillus Cutlery Co., Camillus, N.Y.

[21] Appl. No.: 264,970

[22] Filed: Jun. 24, 1994

[51] Int. Cl.[6] ..... B26B 3/06

[52] U.S. Cl. ..... 30/160; 30/161

[58] Field of Search ..... 30/153, 155, 158, 30/159, 160, 161

[56] References Cited

U.S. PATENT DOCUMENTS

| | | | |
|---|---|---|---|
| 1,647,405 | 11/1927 | Giesen | 30/160 |
| 3,868,774 | 3/1975 | Miori | 30/161 |
| 4,893,409 | 1/1990 | Poehlmann | 30/161 |
| 4,897,922 | 2/1990 | Brooker | 30/160 X |
| 4,918,820 | 4/1990 | Korb et al. | 30/161 |
| 5,111,581 | 5/1992 | Collins | 30/161 |

*Primary Examiner*—Hwei-Siu Payer
*Attorney, Agent, or Firm*—George R. McGuire

[57] ABSTRACT

A knife having a casing and a blade pivotally mounted thereto includes a user actuated button slidably mounted to the casing for producing movement of the blade between fully open and closed terminal positions. The button is disposed on the end of an elongated shaft which fully extends through a spring, pawl, casing, and a blade. The spring and pawl are respectively positioned adjacent the button and between the outwardly facing surface of the casing and the spring. The pawl includes a legged portion which extends into the casing and is fixedly attached to the blade. The pawl is further operatively positioned in relation to a plurality of bosses extending upwardly in longitudinal linear relation from the outwardly facing surface of the casing. As a user slides the button in a predetermined direction, the pawl correspondingly slides and rotates about each successive boss. The sliding, rotating motion of the pawl is directly transferred to the blade, thereby moving the blade between its terminal positions. The elongated shaft further includes a flanged end positioned opposite the user actuated button. The flanged end lockingly engages in one of a plurality of detents thereby locking the blade in a desired position.

58 Claims, 13 Drawing Sheets

304
306
308
310
320
322
324
326
327
334
336
340
342
350
352

FOLDING KNIFE WITH MOVEABLE PIVOT AXIS

BACKGROUND OF THE INVENTION

The present invention relates generally to knives having blades pivotally foldable with respect to a casing. More specifically, the present invention relates to knives having a manually actuated button slidably mounted to the casing which, upon a user exerted force, transmits pivotal motion to the blade, as well as translatory movement of the pivot axis relative to the casing.

Folding knives having user actuated, mechanical drives for opening a knife blade pivotally mounted to a casing are well known in the art. Most common among these folding, or pocket type knives are those having a spring loaded, user-actuated, blade release mechanism. Examples of such knives can be readily seen in U.S. Pat. Nos. 4,893,409 to Poehlmann; 4,897,922 to Brooker; and 4,918,820 to Korb, et al. The springs in these knives tend to lose their resiliency over time, therefore making them less economically attractive and less useful. Furthermore, these knives do not include any means for locking the blade in any one position, thereby permitting the risk of accidental opening or closing of the blade.

Another type of prior art folding knife is having a user-actuated button slidably mounted to the exterior surface of the casing. When the user exerts a force to slide the actuator, the force is transmitted to pivot the blade from its closed to its open position.

This type of knife is exemplified in applicant's issued U.S. Pat. No. 4,719,700. The knife disclosed in this patent uses a non-extensible linkage having one end connected to the actuator and its second end wrapped around a wheel connected to the blade. The user exerted force, in this case, is transmitted by the non-extensible linkage to rotate the wheel, thereby pivoting the blade from its closed to its open position.

An alternate embodiment of the above described patent reveals a similar operation using a plurality of intermeshing gears instead of a non-extensible linkage and wheel. Both embodiments utilize a blade locking mechanism typically found in what is known in the art to be "lock back" knives.

A common feature of all conventional folding knives, regardless of the manner of effecting blade movement, is a blade pivot axis which is stationary relative to the casing.

SUMMARY OF THE INVENTION

It is a principal object of the present invention to provide a folding knife having an improved, user-actuated blade opening mechanism.

It is a further object of the present invention to provide a folding knife which is easily manipulated by a user thereof.

It is an additional object of the present invention to provide a folding knife having an improved locking mechanism to prevent the accidental opening or closing of the blade.

It is another object of the present invention to provide a folding knife of minimal dimensions so as to be easily stored and held.

It is yet a further object of the present invention to provide a folding knife which is readily attachable to a variety of knife handles.

Another object is to provide a folding knife having a blade pivotally moveable between closed and open positions with respect to a casing wherein the blade pivot axis moves as the blade rotates.

Other objects and advantages of the present invention will in part be obvious and in part appear hereinafter.

In accordance with the foregoing objects and advantages, the present invention provides several embodiments of a folding knife having a user-actuated blade opening mechanism. The knife itself is generally comprised of a casing having first and second opposed walls; a blade pivotally mounted for movement between closed and open positions with respect to the casing; and a user-actuated button slidably mounted to the casing for producing simultaneous pivotal movement of the blade and translatory movement of the pivot axis. The knife further includes a blade locking feature which prevents accidental displacement of the blade from the closed or open positions.

In two of the disclosed embodiments, first and second axially aligned slots are respectively, longitudinally formed through the casing's two walls. A line of equally spaced apart bosses protrude from the outwardly facing surface of the first casing wall in parallel, laterally offset relation to the slot formed therethrough with the peripheries of the bosses in one of the embodiments being round and the bosses of the other embodiment being semi-circular.

The user-actuated button is connected to one end of an elongated shaft which extends through a coiled spring, a pawl, both slots formed through the casing walls, and an aperture formed through the tang portion of the blade, thus defining the blade pivot axis. The pawl is positioned adjacent the outwardly facing surface of the first casing wall, and the spring is disposed between the pawl and the button. The pawl further includes a legged portion which extends downwardly into the casing where it is fixedly attached to the blade.

Upon initiation of a user exerted force applied to the button, the shaft freely, longitudinally slides within the confines of the slots. As the shaft slides along, the longitudinal, sliding motion thereof is transferred to the pawl. The pawl has peripheral, spaced teeth which engage the spaces defined between the bosses. Indented portions between successive teeth are semicircular or otherwise cooperatively shaped to conform to the peripheries of the bosses. This engagement causes the pawl to rotate about the shaft while simultaneously sliding longitudinally across the casing wall. Due to the pawl's attachment to the blade, the sliding-rotary motion of the pawl is directly transferred to the blade, thereby causing it to pivot into and out of the casing as the pivot axis, defined by the shaft extending through the blade tang, moves along the casing.

The shaft further includes a flanged end positioned opposite the button. This flanged end lockingly engages in either of two detent openings formed in intersecting relation with the slots of the second casing wall. When the button is released by a user's thumb, the spring causes the entire shaft to move axially in the direction of the end carrying the button. This causes the flanged end to become engaged in one of the detents, which securely locks the blade in either its fully open or fully closed positions.

The most significant difference between the two embodiments discussed above, is that one of the embodiments minimizes the size of the blade casing, and further includes means positioned on the casing for attachment of any of a plurality of differently styled knife handles, while the other includes a more conventional casing. The details of this will be discussed in greater detail hereinafter.

In a third, alternate embodiment, the shaft defining the blade pivot axis which fully extends through elongated slots in the casing walls, a circular gear or pinion fixedly attached to the tang end of the blade. An elongated, toothed gear rack is integrally formed along one side of one of the casing slots in operable position with respect to the pinion. Movement of the blade is effected by the user sliding the button along the slot, thereby causing the stationary rack to rotate the pinion. This rotary motion effects pivotal movement of the blade between its open and closed terminal positions. This blade, like the ones of the other embodiments may be releasably locked in either of the two previously mentioned positions.

A fourth, alternate embodiment differs from the other three in that it includes an cam shaped gear fixedly attached to or formed integrally with the tang end of the blade and positioned between the two casing walls. This embodiment further includes a curved gear bed positioned between the two casing walls for meshing engagement with the cam shaped gear. As the button is slid along the casing wall, in the same manner as all the other embodiments, the cam shaped gear engages corresponding teeth of the curved gear bed. Therefore, as the gear moves along the gear bed, the blade pivotally moves between its open and closed positions as the pivot axes moves with respect to the casing.

DETAILED DESCRIPTION

Figure 1:
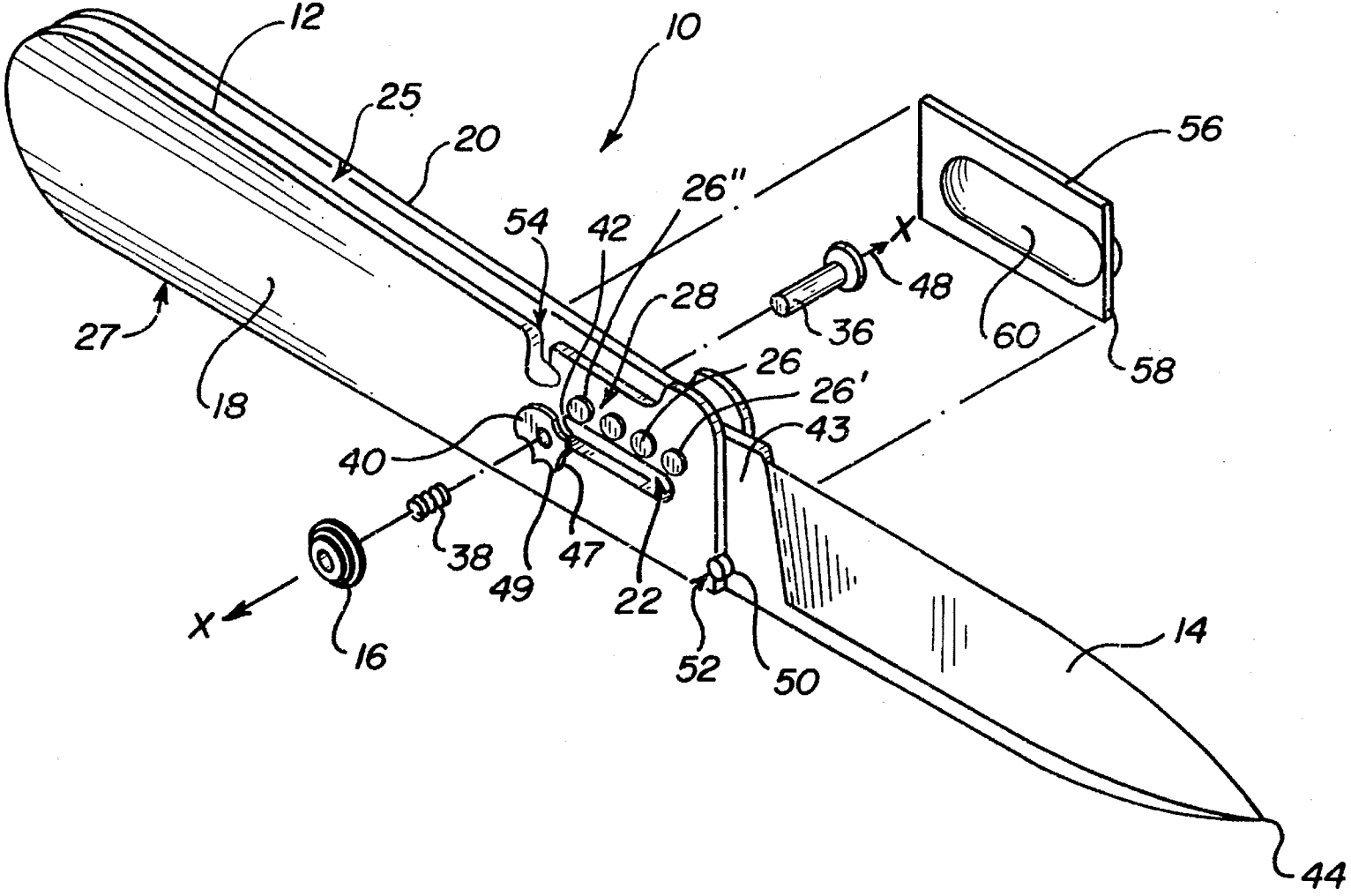
FIG. 1 is a perspective view of a first embodiment of a folding knife, embodying the present invention, shown in its open position.

Referring now to the drawing figures wherein like reference numerals denote like parts throughout all views, there is seen in FIG. 1 a folding knife generally denoted by reference numeral 10. Knife 10 is seen to be generally comprised of a casing 12, a blade 14 pivotally mounted for movement between closed and open positions with respect to casing 12, and a user actuated button 16 slidably mounted with respect to casing 12 for producing pivotal movement of blade 14 and translatory movement of the axis about which blade 14 pivots.

Figure 2:
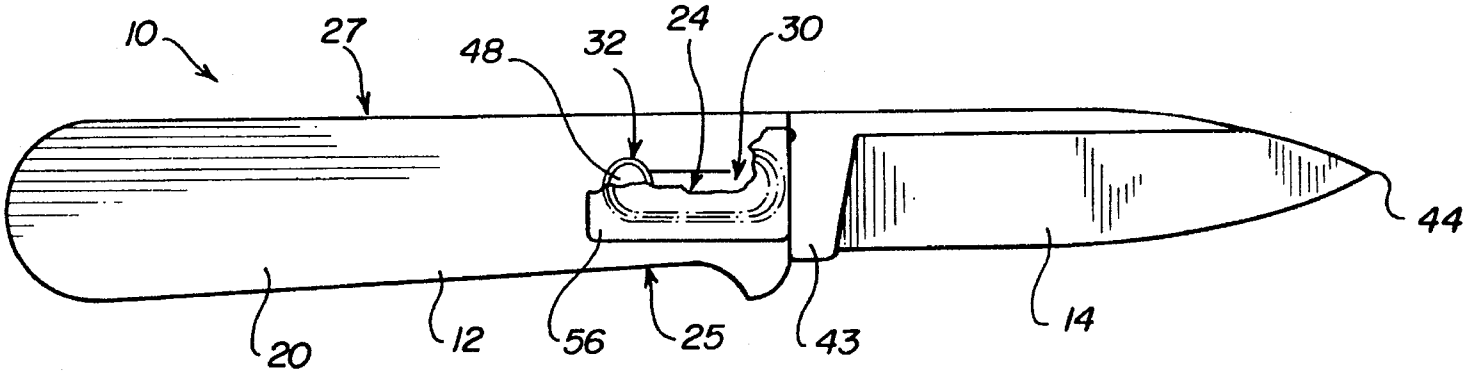
FIG. 2 is a bottom plan view of the knife of FIG. 1, with portions broken away.
Figure 3:
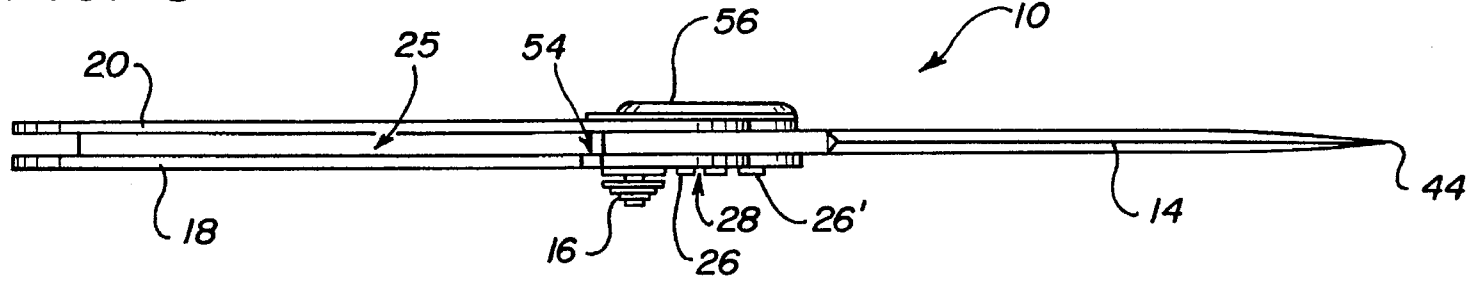
FIG. 3 is a side elevational view of the knife of FIG. 1.
Figure 4:
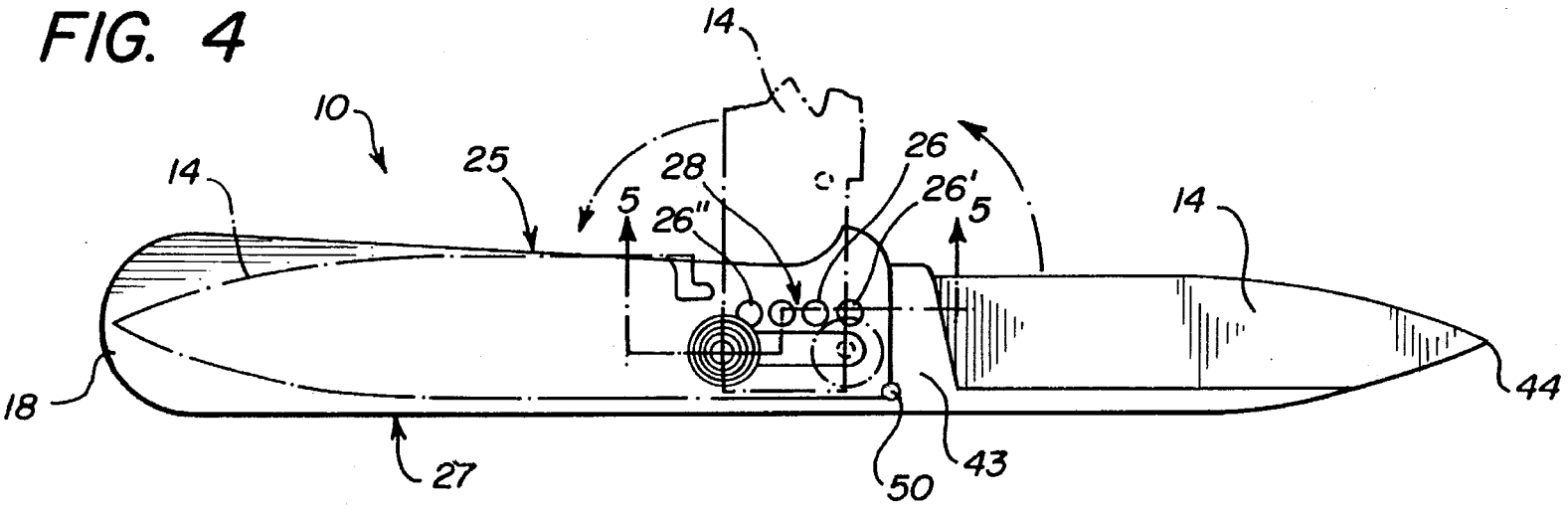
FIG. 4 is a top plan view of the knife of FIG. 1 showing, in phantom, alternate positions of the blade.
Figure 5:
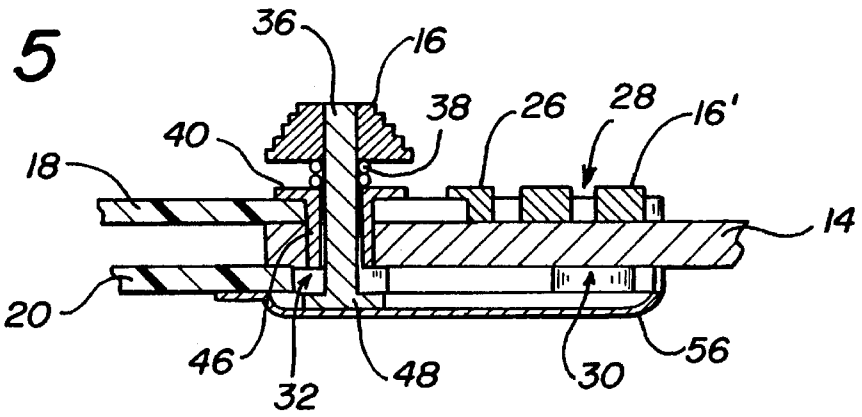
FIG. 5 is a cross-sectional view taken along line 5—5 of FIG. 4.

Casing 12 is seen to include first and second opposed walls 18 and 20, respectively, having corresponding, axially aligned, longitudinally elongated, first and second slots 22 and 24 formed therethrough. Casing 12 further includes a blade receiving edge 25 and a closed edge 27, as well as a plurality of equally spaced apart, circular bosses 26 (the end bosses are denoted as 26' and 26") protruding from the outwardly facing surface of first wall 18 in a line extending in parallel, laterally offset relation between slot 22 and blade receiving edge 25. A plurality of open spaces 28 are defined between adjacent bosses 26. As clearly seen in FIGS. 2 and 5, casing 12 further includes two laterally spaced circular detent openings 30 and 32 cut out from wall 20 in intersecting relation to slot 24. Detent openings 30 and 32 are used to securely lock blade 14 in either its fully open or fully closed positions, respectively, the details of which will be more fully explained hereinafter. In addition, the circular shape and predetermined number of detents are disclosed as a preferred embodiment, but the spirit and scope of the invention should extend as defined by the appended claims.

User actuated button 16 is fixedly attached to one end of an elongated shaft 36 which fully extends through a coiled spring 38, a pawl 40, first slot 22, an aperture 42 formed through the tang portion 43 of blade 14 which is located opposite pointed tip 44, and second slot 24, thus defining the blade pivot axis X—X which, as mentioned earlier, moves with respect to casing 12 in response to the sliding of button 16. (Axis X—X will be used in all disclosed embodiments.) Pawl 40 is positioned adjacent the outwardly facing surface of first casing wall 18, and spring 38 is disposed between pawl 40 and button 16. When button 16 is securely attached to shaft 36, spring 38 becomes slightly compressed, thereby producing equal and opposite biasing forces to button 16 and pawl 40. Pawl 40 includes a legged portion 46 which extends downwardly into casing 12 where it is fixedly attached to blade 14 about the periphery of aperture 42, and a plurality of teeth 47 which are alternately positioned between arcuate cutouts, or indentations, 49 formed in pawl 40. Teeth 47 are appropriately spaced to correspondingly engage with respective spaces 28, with arcuate cutouts 49 wrappingly engaging respective bosses 26.

Shaft 36 further includes a circularly flanged end 48 positioned opposite button 16. Flanged end 48 is configured to correspond in shape to detent openings 30 and 32. When no downward force is applied to button 16, flanged end 48 will become lockingly engaged within an aligned one of detent openings 30 and 32 due to the biasing force supplied to button 16 by spring 38. When flanged end 48 engages detent opening 32, blade 14 will be locked in its operable, fully open position. Likewise, when it engages detent opening 30, blade 14 is locked in its fully closed position.

Upon application of an inward, user exerted force to button 16, flanged end 48 will become disengaged from detent opening 30 or 32. Application of force to button 16 longitudinally of the handle will then cause shaft 36, along with its connected parts, to slide within the confines of slots 22 and 24 in the direction of applied longitudinal force. Due to shaft 36 extension through pawl 40, the sliding motion of shaft 36 is transferred directly thereto. As pawl 40 moves longitudinally of slot 22, teeth 47 successively engage respective spaces 28 and arcuate cutouts 49 wrappingly engage respective bosses 26, thereby imparting rotational motion to pawl 40. This longitudinal-rotational motion of pawl 40 is, in turn, directly transferred to blade 14 due to its fixed connection to the pawl, thus affecting translatory movement of pivot axis X—X with respect to casing 12. The translational motion supplied to blade 14 causes it to pivotally move between its open and closed positions. Once pawl 40 engages either of the end bosses 26', 26" blade 14 is nearly positioned in it corresponding terminal position. To fully position blade 14 in its terminal positions it is necessary for the user to continue to longitudinally slide button 16 a slight distance in the appropriate direction (approximately 1/16 inch) after engaging end boss 26' or 26". In doing this, pawl 40 becomes disengaged from end bosses 26', 26" and does not rotate, causing pin 50 on tang 43 to engage an appropriately positioned notch 52 or L-shaped notch 54 in wall 18. Pin 50 and notches 52 and 54 will be described in further detail hereinafter. By pulling button 16 towards the rear of casing 12, blade 14 will pivotally move towards it open position. It is therefore obvious that pushing of button 16 towards the front of casing 12 will cause blade 14 to pivotally move towards its closed position. It should further be noted that while button 16 and shaft 36 slide with pawl 40, they do not rotate along with pawl 40 thereby decreasing internal friction and permitting easy opening and closing of blade 14.

Blade 14 includes pin 50 which projects outwardly in a direction perpendicular to the plane in which wall 18 lies. When blade 14 is in either its fully open or fully closed positions, pin 50 engages notch 52 or L-shaped notch 54, respectively, which secures its position and prevents any inadvertent movement from those positions. Notches 52 and 54 are formed at appropriate positions in blade receiving edge 25 of wall 18 as is clearly seen in FIG. 1 to permit flange 48 to securely engage detent openings 30 or 32 when pin 50 is engaged in the corresponding notch.

Knife 10 further includes a blade lock cover 56. Cover 56 is fixedly attached to the outwardly facing surface of wall 20 in covering relation to slot 24 and detents 30 and 32. Cover 56 prevents any dust or other foreign particles which could accumulate and cause the locking mechanism to become jammed and unfunctionable. Cover 56 does not hinder the performance of knife 10 whatsoever as it includes a wall contacting portion 58 which surrounds, but does not contact, any portion of slot 24 and detents 30 and 32, and a bubble portion 60 which projects in spaced, covering relation to slot 24 and detents 30 and 32. Bubble 60 is spacious enough to permit flanged end 48 to slide between detents 30 and 32, but is not overly large so as to become burdensome to a user holding knife 10.

Figure 6:
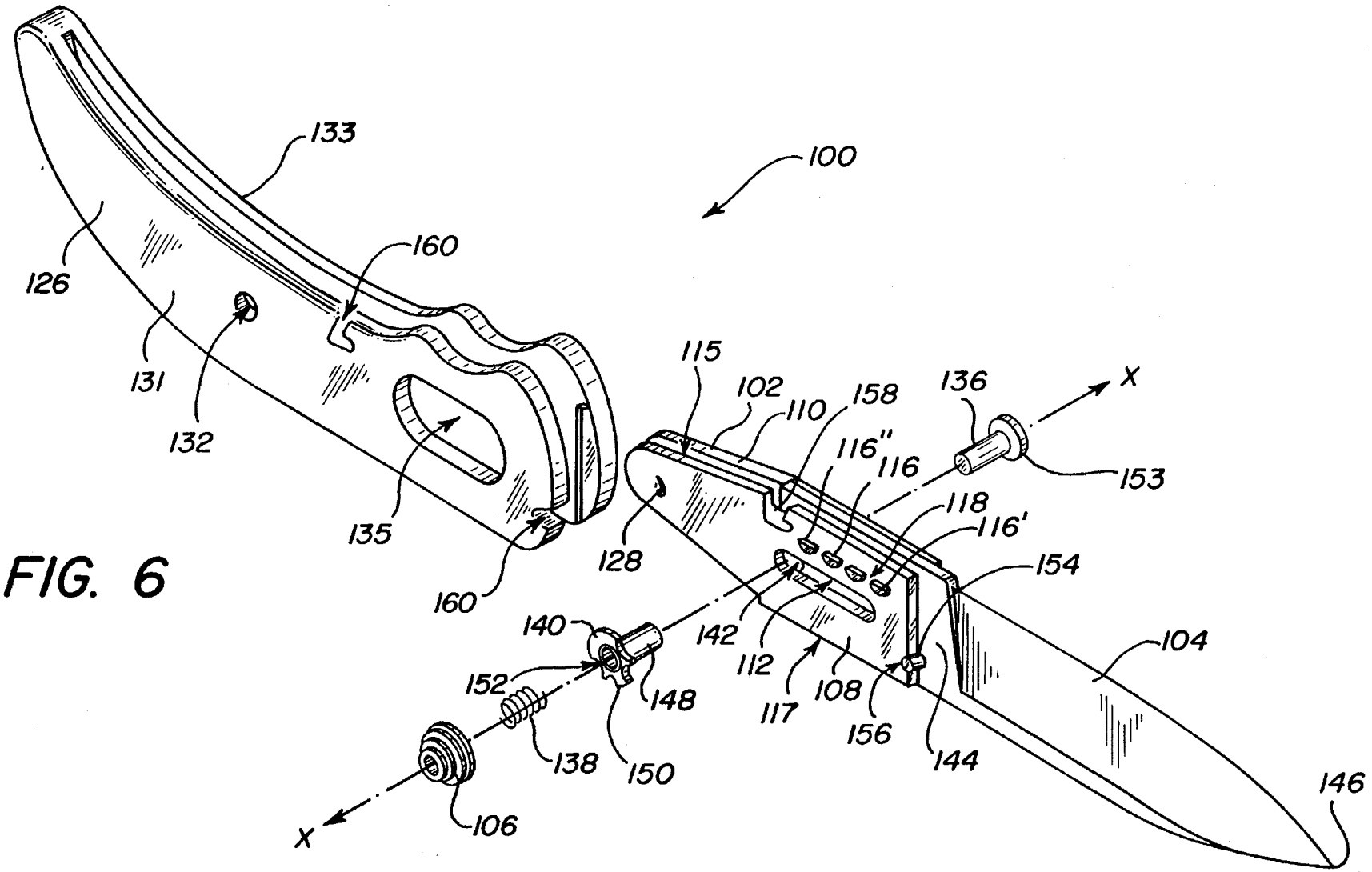
FIG. 6 is an exploded perspective view of a second embodiment of a folding knife.

Referring now to FIG. 6, there is seen a second embodiment of a folding knife, denoted generally by reference numeral 100. As with knife 10, knife 100 is generally comprised of a casing 102, a blade 104 pivotally mounted for movement between closed and open positions with respect to casing 102, and a user actuated button 106 slidably mounted to casing 102 for producing pivotal movement of blade 104 and translatory movement of blade pivot axis X—X.

Figure 7:
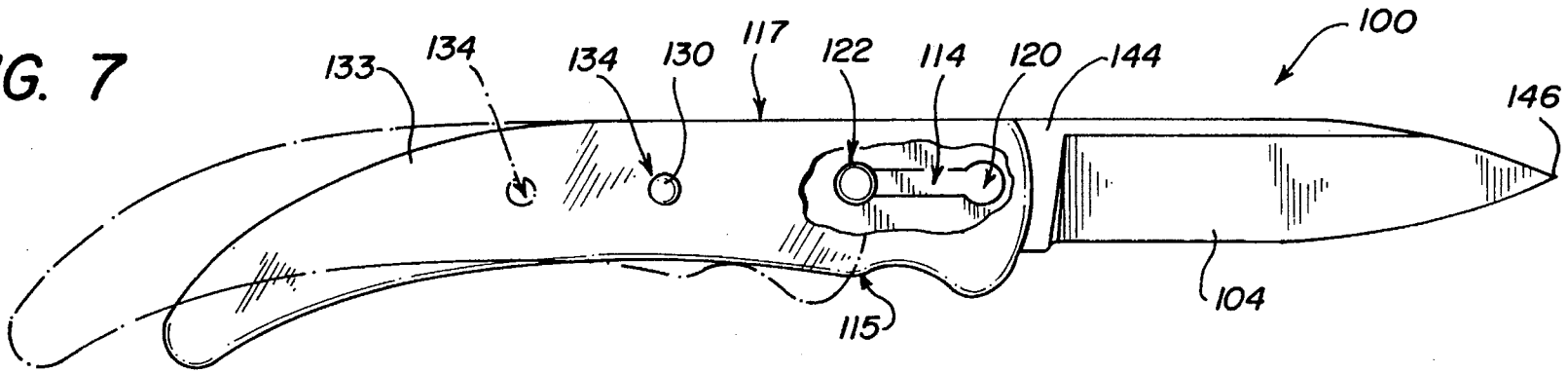
FIG. 7 is a bottom plan view of the knife of FIG. 6 with portions broken away and a removable handle attached thereto.
Figure 8:
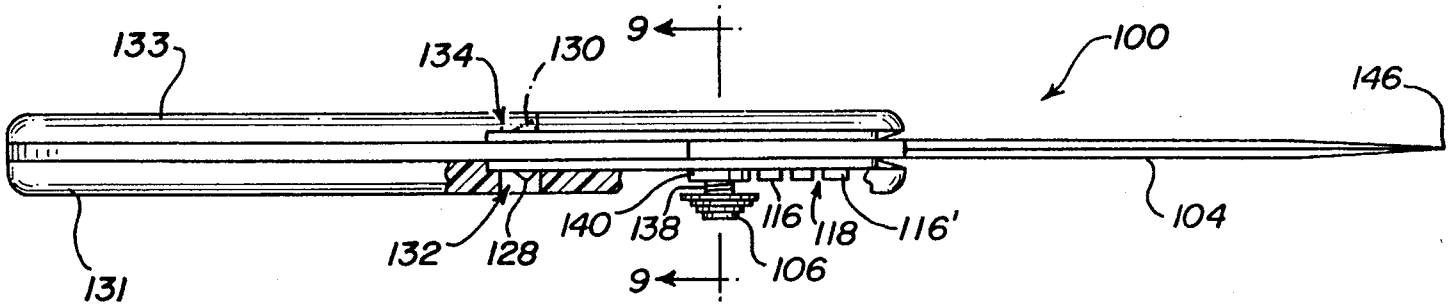
FIG. 8 is a side elevational view of the knife of FIG. 7.
Figure 9:
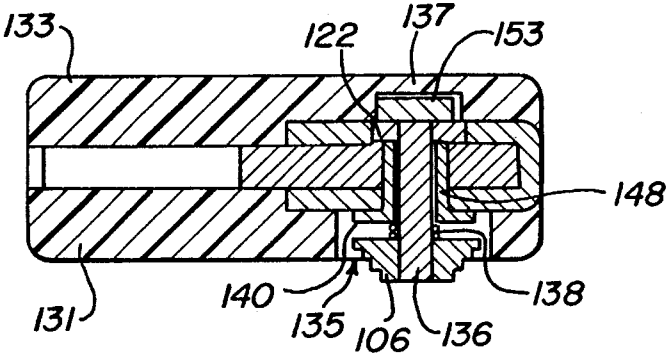
FIG. 9 is a cross-sectional view taken along line 9—9 of FIG. 8.
Figure 10:
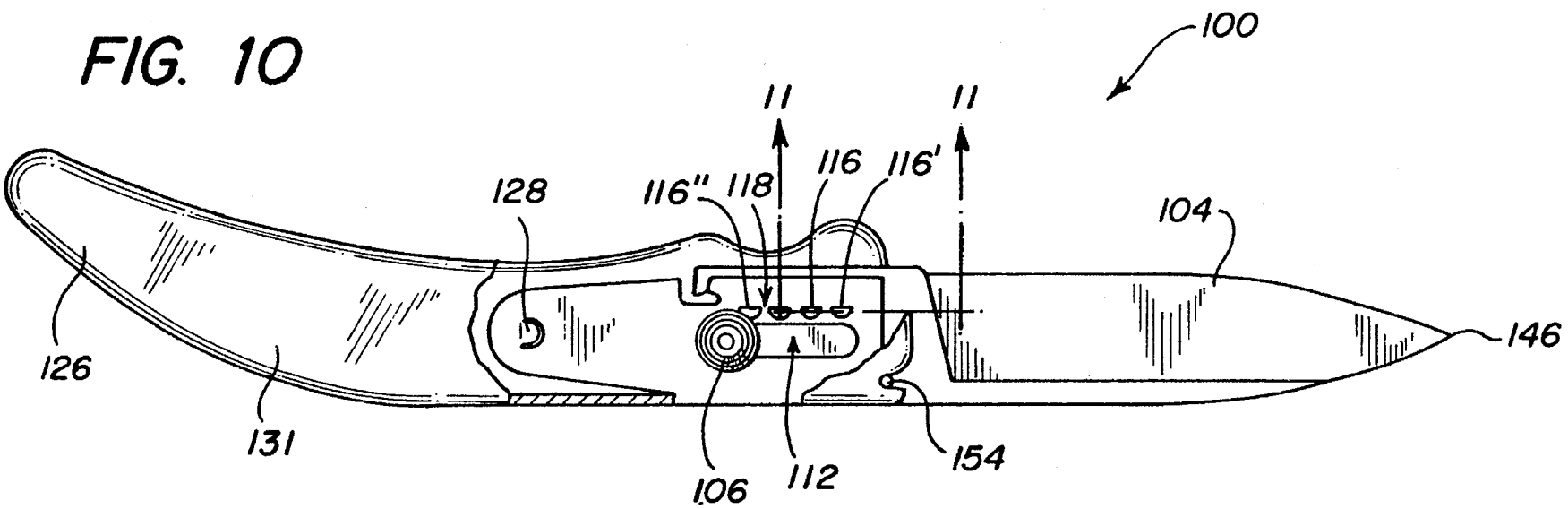
FIG. 10 is a top plan view of FIG. 7.
Figure 11:
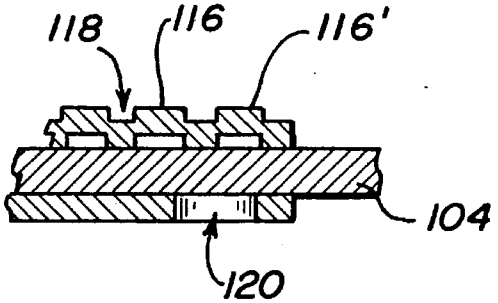
FIG. 11 is a cross-sectional view taken along line 11—11 of FIG. 10.
Figure 12:
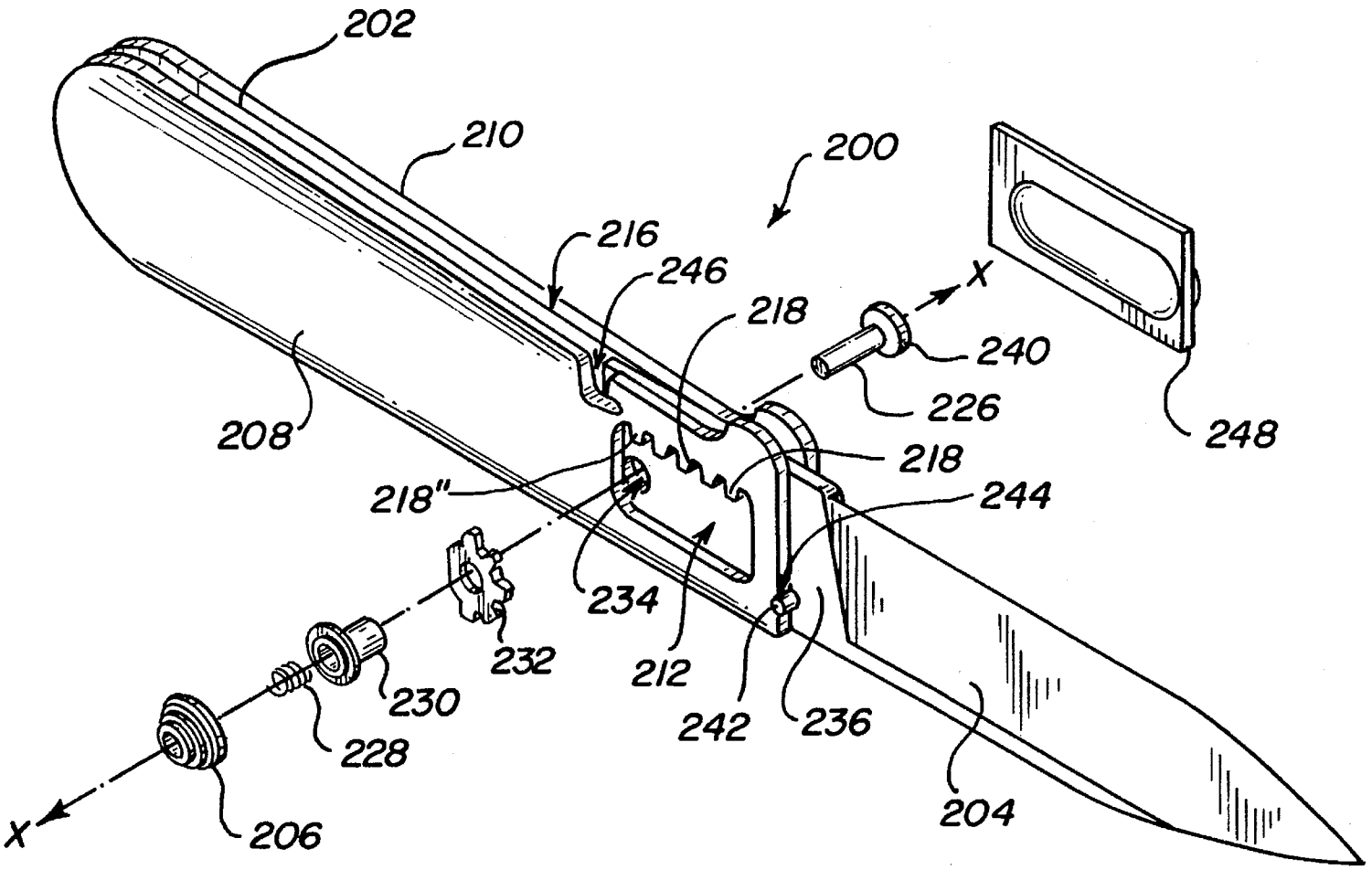
FIG. 12 is an exploded, perspective view of a third embodiment of a folding knife, shown in its open position.
Figure 13:
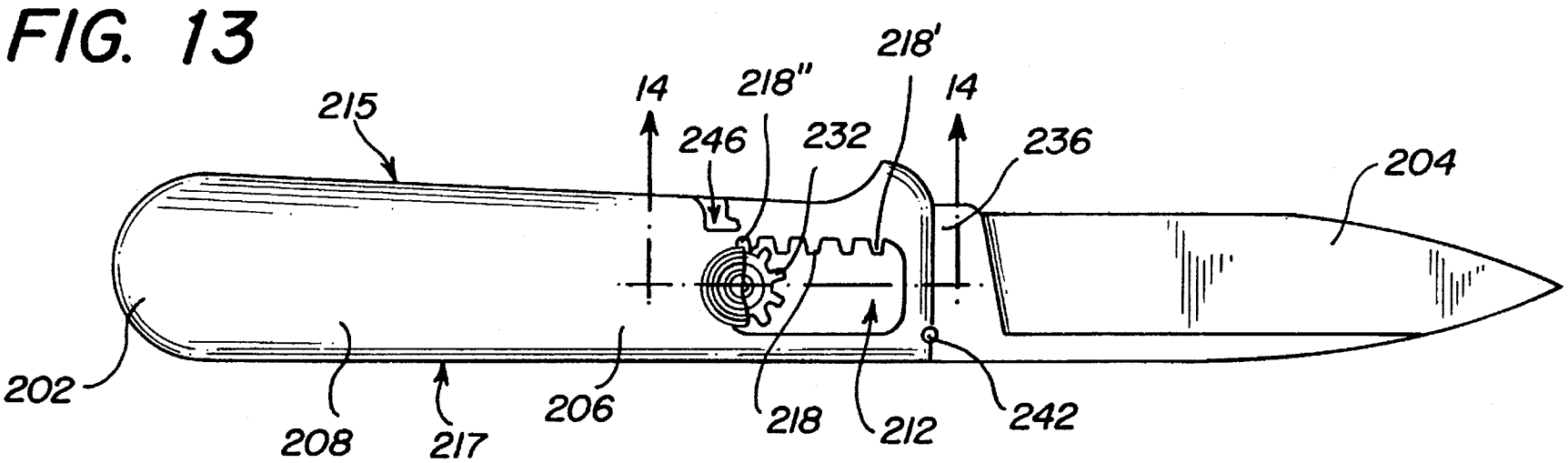
FIG. 13 is a top plan view of the knife of FIG. 12 showing portions cut away.
Figure 14:
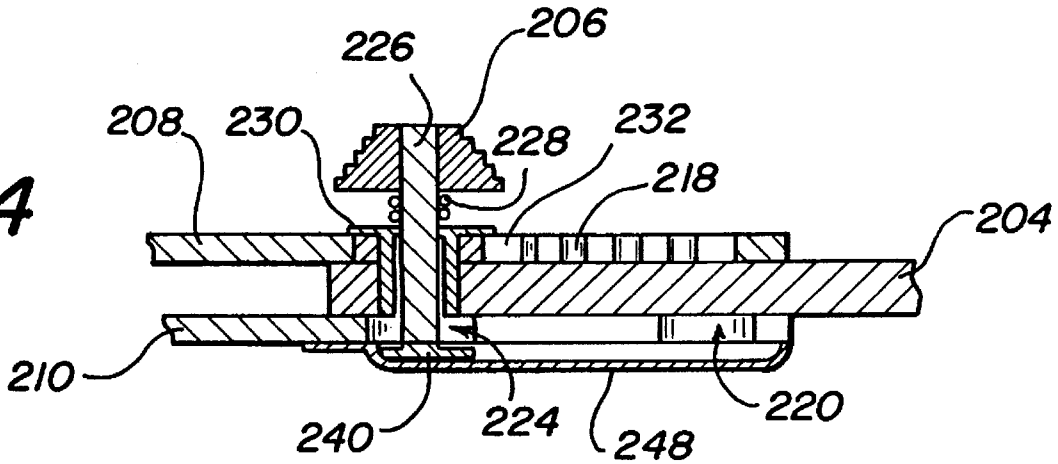
FIG. 14 is a cross-sectional view taken along line 14—14 of FIG. 13.
Figure 15:
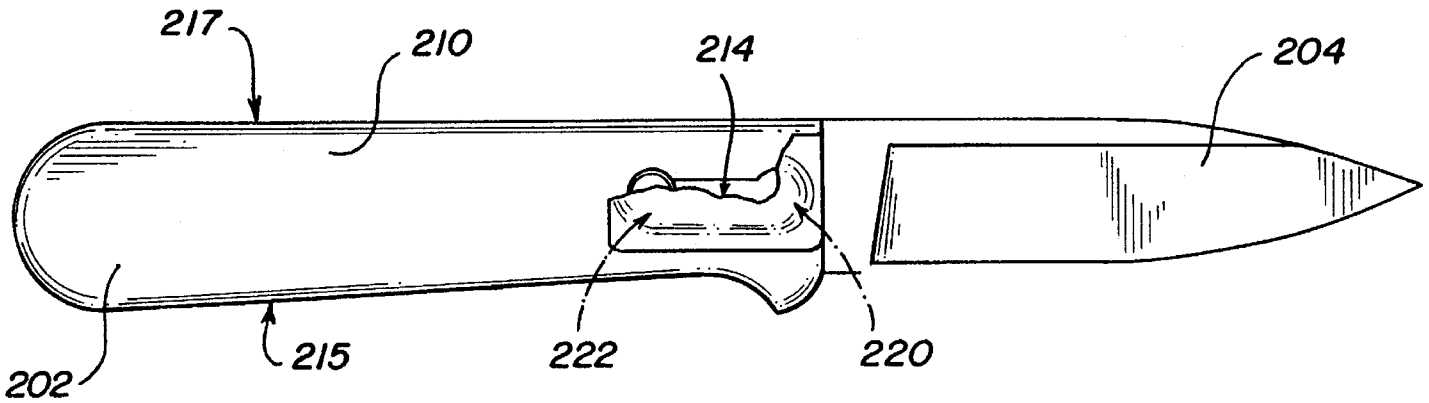
FIG. 15 is a bottom plan view of the knife of FIG. 12.
Figure 16:
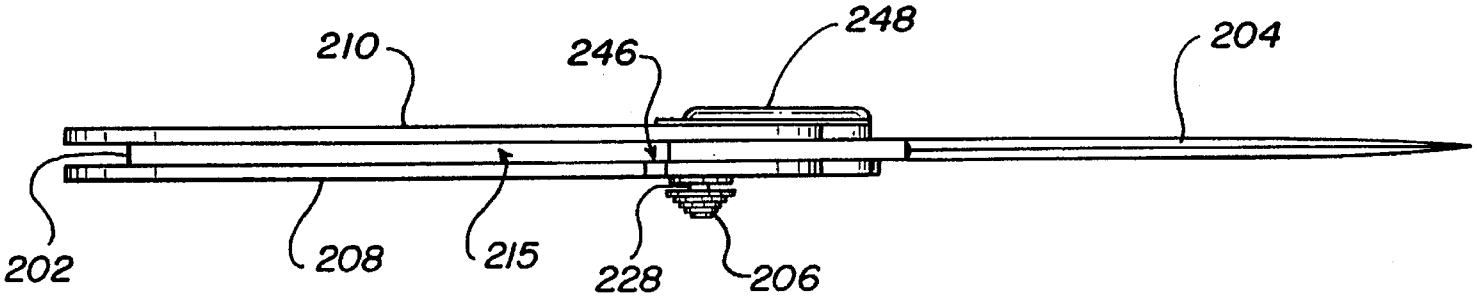
FIG. 16 is side elevational view of the knife of FIG. 12.
Figure 17:
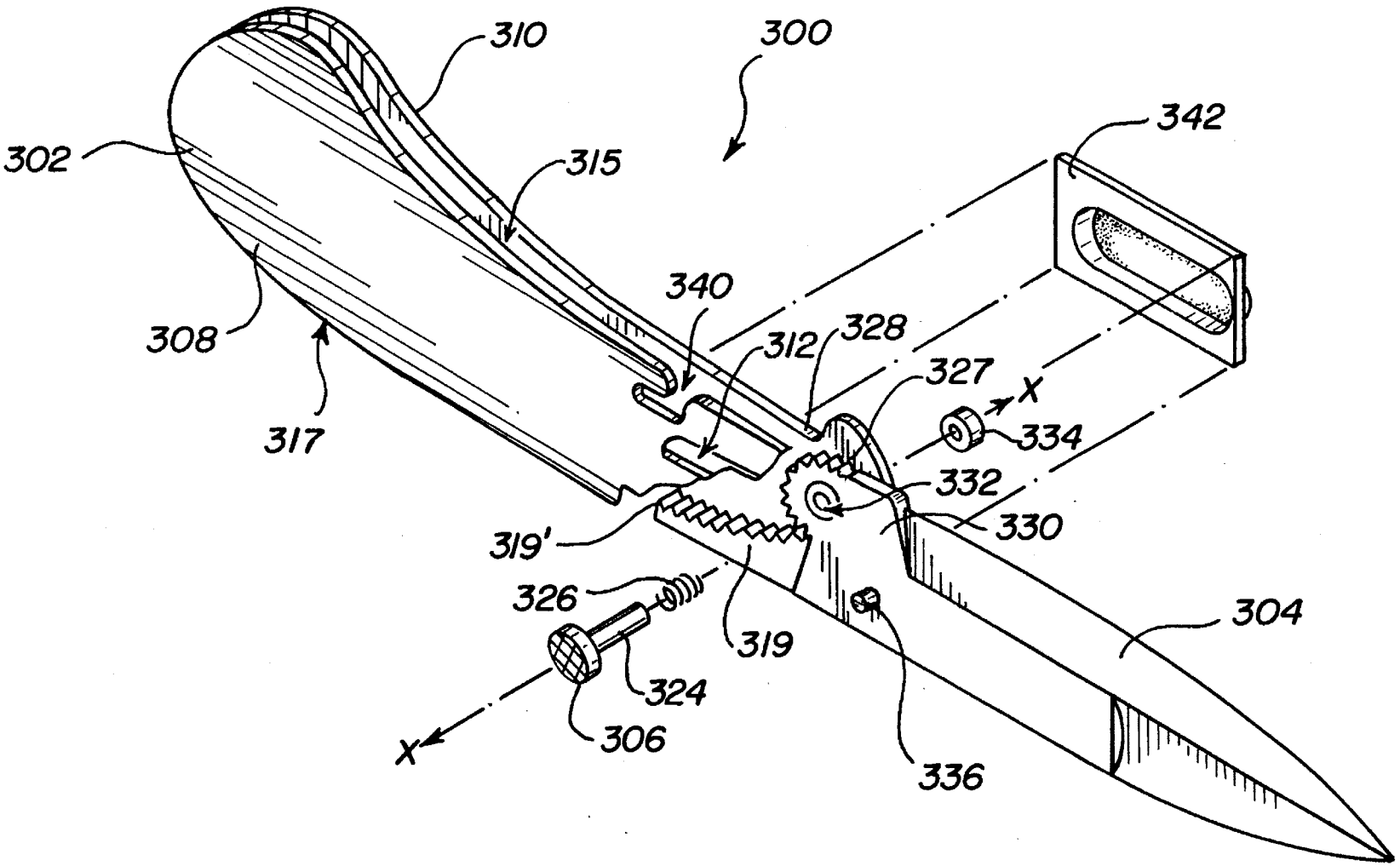
FIG. 17 is an exploded, perspective view of a fourth embodiment of a folding knife, shown in its open position.
Figure 18:
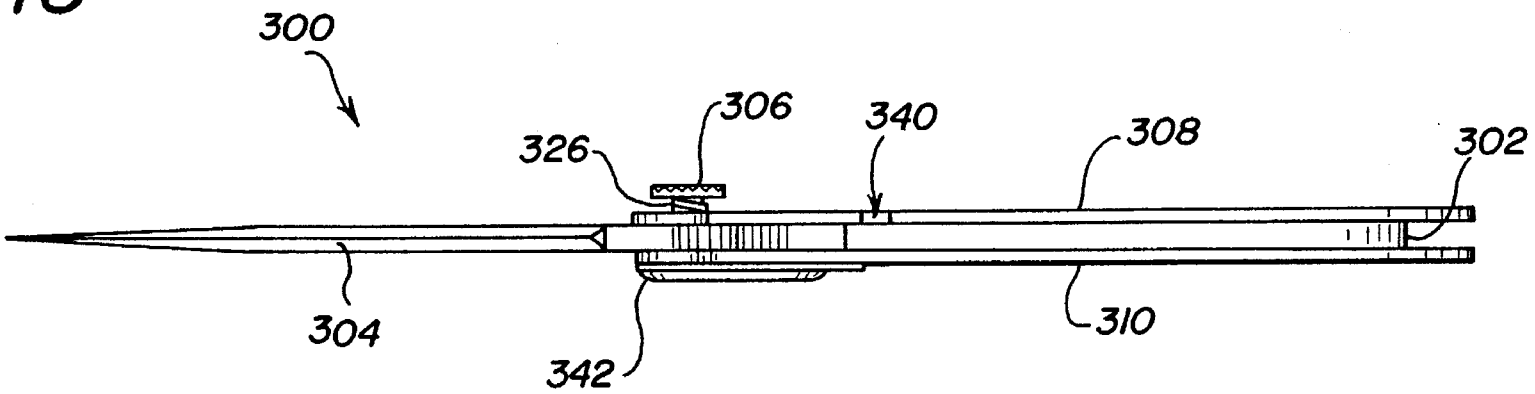
FIG. 18 is a side elevational view of the knife of FIG. 17.
Figure 19:
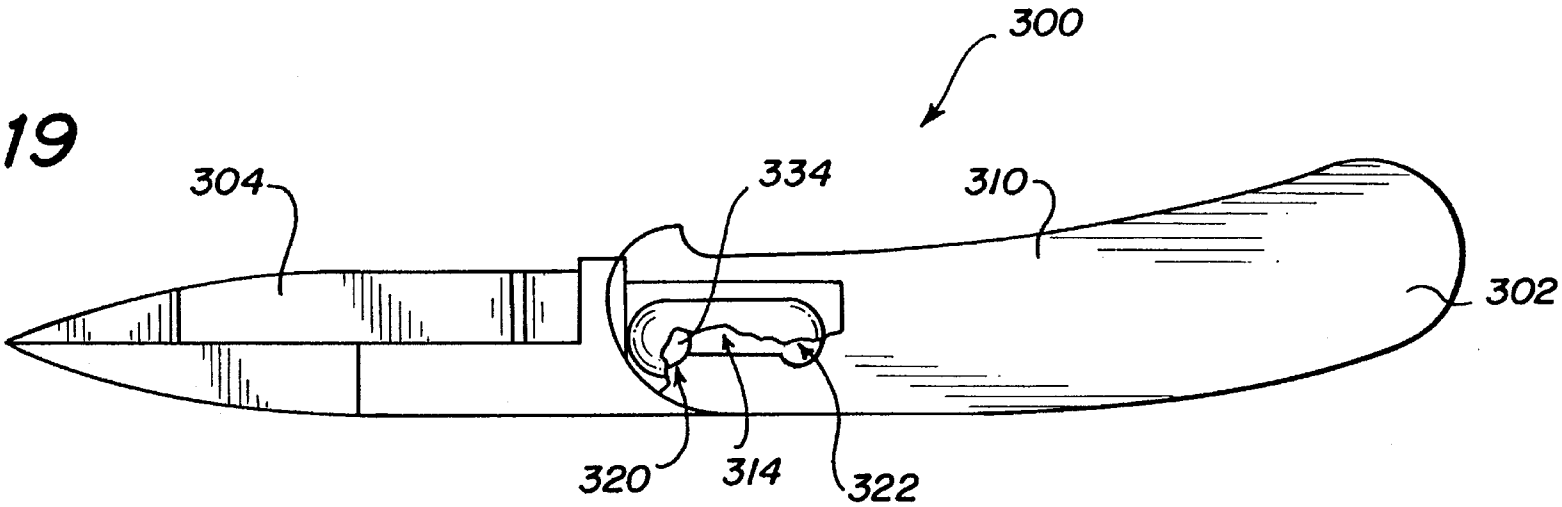
FIG. 19 is a bottom plan view of the knife of FIG. 17.
Figure 20:
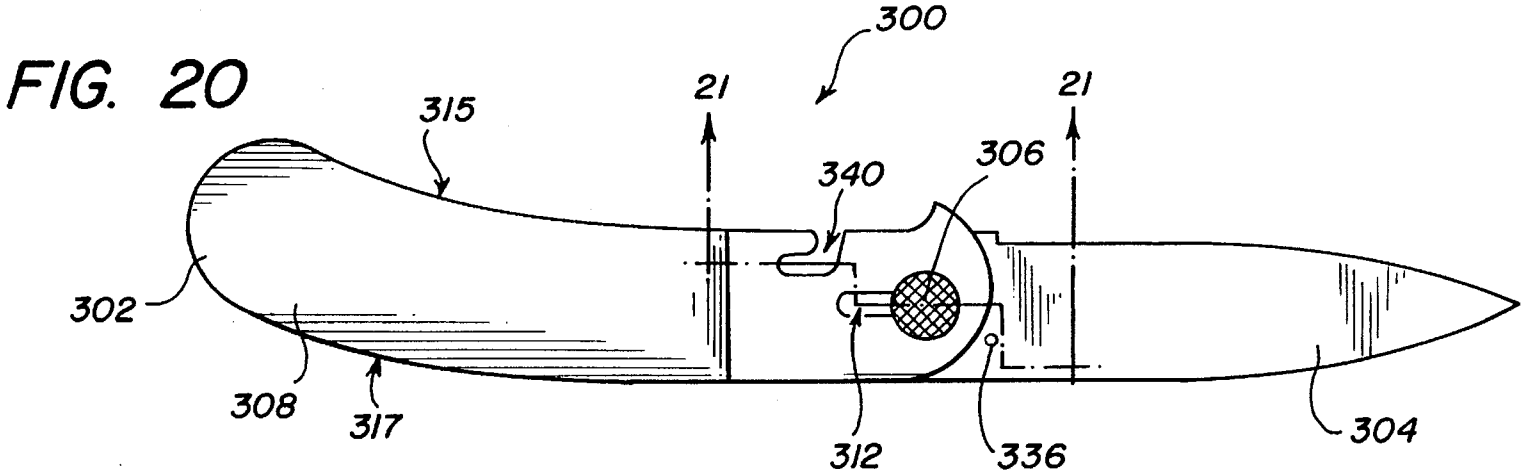
FIG. 20 is a top plan view of the knife of FIG. 17.
Figure 21:
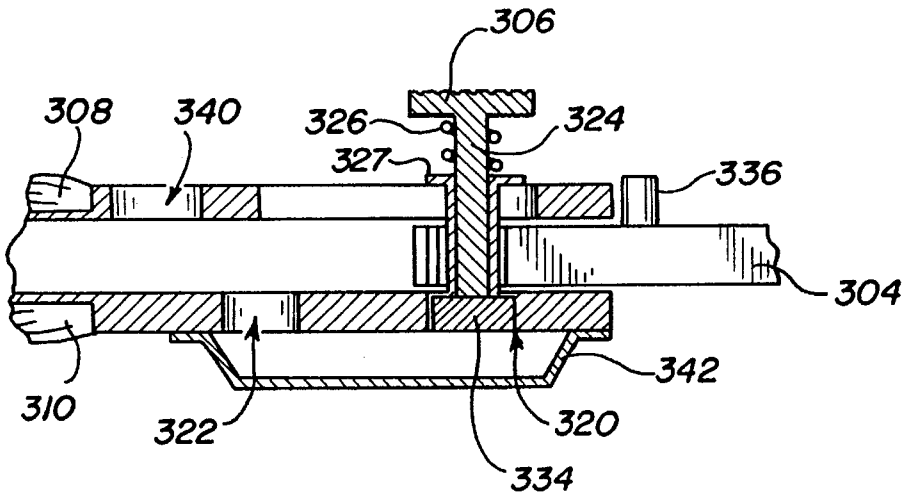
FIG. 21 is a cross-sectional view taken along line 21—21 of FIG. 20.

Casing 102 is seen to include first and second opposed walls 108 and 110 having corresponding, axially aligned, longitudinally elongated, first and second slots 112 and 114 formed therethrough, respectively. Casing 102 further includes a blade receiving edge 115 and a closed edge 117, as well as a plurality of equally spaced apart, semi-circular bosses 116 (the end bosses are denoted by 116' and 116") protruding from the outwardly facing surface of wall 108 in a line extending in parallel, laterally offset relation to slot 112. The circular portion of bosses 116 are positioned in closest proximity to slot 112 with their flattened portions being positioned farthest therefrom. A plurality of spaces 118 are clearly defined between adjacent bosses 116. As seen most clearly in FIG. 7, casing 102 further includes two laterally spaced circular detent openings 120 and 122 cut out from wall 110 in intersecting relation with slot 114. As with detent openings 30 and 32, detent openings 120 and 122 are used to securely retain blade 104 locked in one of the two positions.

The main difference between casing 12 and 102 is that casing 102 is of the minimum size necessary to contain all the operable blade opening elements. Therefore, to permit knife 100 to be safely held by a user thereof, a knife handle 126 must be attached to casing 102. Casing 102 includes handle detents 128 and 130 protruding in aligned relation respectively from the outwardly facing surfaces of walls 108 and 110. Detents 128 and 130 permit handle 126 to be releasably attached to casing 102.

Handle 126 includes opposing walls 131 and 133 which straddle casing 102, and further include respective, laterally aligned, detent receiving apertures 132 and 134 formed through walls 131 and 133, a cut out portion 135 for permitting access to user actuated button 106, and a hollowed out clearance area 137 positioned around detents 120 and 122. As is clearly seen in FIG. 7, handle 126 may be slid onto casing 102 in the direction indicated by the arrows, until detents 128 and 130 securely engage apertures 132 and 134. Although handle 126 is shown as being an elongated, curvilinear shape, it may include any ornamentalities and desirous shapes, as long as it includes a means for attaching itself to casing 102.

As in the previously described embodiment, user actuated button 106 is fixedly attached to one end of an elongated shaft 136 which fully extends through a coiled spring 138, a circular pawl 140, first slot 112, an aperture 142 formed through the tang portion 144 of blade 104 positioned opposite pointed tip 146, and second slot 114, again defining pivot axis X—X. Pawl 140 is positioned adjacent the outwardly facing surface of wall 108, and spring 138 is disposed between pawl 140 and button 106. Spring 138 is slightly compressed between button 106 and pawl 140, thus producing equal and opposite biasing forces respectively to button 106 and pawl 140. Pawl 140 includes a legged portion 148 which extends downwardly into casing 102 where it is fixedly attached to blade 104 about the periphery of aperture 142, and a plurality of teeth 150 alternately positioned between arcuate cutouts, or indentations, 152 formed in pawl 140. Teeth 150 are appropriately spaced to correspondingly engage with respective spaces 118, with arcuate cutouts 152 wrappingly engaging respective bosses 116.

Shaft 136, as before, includes a substantially circularly flanged end 153 positioned opposite button 106. Flanged end 153 is shaped to lockingly engage either of detents 120 and 122 as described in the previous embodiment.

Once pawl 140 engages either of the end bosses 116', 116", blade 104 is nearly positioned in either of its terminal positions. As with the first embodiment, to fully position blade 104 in one of its terminal positions it is necessary for the user to continue to longitudinally slide button 106 a slight distance in the appropriate direction (approximately 1/16 inch). In doing this, pawl 140 becomes disengaged from end bosses 116', 116" and a pin 154 engages an appropriately positioned notch 156 or L-shaped notch 158. Pin 154 projects outwardly from blade 104 in a direction perpendicular to plane in which wall 108 lies. When blade 104 is in either its fully open or fully closed positions, pin 154 engages notch 156 or L-shaped notch 158, respectively, which secures its position and prevents any inadvertent movement from that position. Notches 156 and 158 are formed at appropriate positions in the blade receiving edge 115 of wall 108 as is clearly seen in FIG. 6 to permit flange 153 to securely engage detent openings 120 and 122 when pin 154 is engaged in the corresponding notch. Furthermore, a notch 160 is formed in handle 126 to accommodate pin 154 when blade 104 is in its open position.

It should again be noted that while button 106 and shaft 136 slide along with pawl 140, they do not rotate along with pawl 140, thereby decreasing internal friction and permitting easy opening and closing of blade 104.

The functional operation of knife 100 is substantially identical to that of knife 10 and will therefore not be explained in any further detail.

Referring now to FIGS. 12–16, there is seen a third alternate embodiment of a folding knife, designated generally by reference numeral 200. Knife 200 is generally comprised of a casing 202, a blade 204 pivotally mounted for movement between closed and open positions with respect to casing 202, and a user actuated button 206 slidably mounted to casing 202 for producing pivotal movement of blade 204 and translatory movement of pivot axis X—X.

Casing 202 is seen to include first and second opposed walls 208 and 210, respectively, first wall 208 having a rectangular opening 212 longitudinally formed therethrough, and second wall 210 having a longitudinally elongated slot 214, as in the first two embodiments, formed therethrough. Casing 202 further includes a blade receiving edge 215 and a closed edge 217. The elongated edge of opening 212 adjacent the blade receiving 215 of casing 202 includes a longitudinally elongated gear rack 218 (the end teeth of the gear rack are denoted 218' and 218") integrally attached thereto. Wall 210 includes two, longitudinally spaced apart, circular detent openings 220 and 222 cut out therefrom in intersecting relation to slot 214. Detent openings 220 and 222 are used to securely lock blade 204 in either of the two detent positions in the same manner as with the first two embodiments.

User actuated button 206 is fixedly attached to one end of an elongated shaft 226 which fully extends through a coiled spring 228, flanged bushing 230, a segmented gear, or pinion, 232, opening 212, an aperture 234 formed through the tang portion 236 of blade 204, and slot 214, again defining pivot axis X—X. Segmented gear 232 is fixedly connected to the tang portion 236 of blade 204 adjacent wall 208, and positioned in meshing engagement with gear rack 218, while bushing 230 extends through and is fixedly attached to gear 232 and aperture 234 with its flanged portion abutting gear 232 opposite blade 204.

Shaft 226 further includes a flanged end 240 positioned opposite button 206. Flanged end 240 provides the blade locking mechanism for knife 200, just as flanged ends 48 and 153 do for their respective knives.

Upon initiation of a downward and longitudinally applied user exerted force to button 206, flanged end 240 becomes disengaged from detent 220 or 222. Therefore, shaft 226, along with its connected parts, slides within the confines of slot 212 in the direction of the applied force. Due to shaft's 226 extension through gear 232, the sliding motion of shaft 226 is transferred directly to gear 232. As gear 232 slides longitudinally along, its teeth cooperatively engage respective spaces formed between the teeth of gear rack 218, thereby imparting rotational motion thereto as well as translatory motion to axis X—X. Due to gear's 232 permanent attachment to blade 204, the simultaneous linear-rotational motion of the gear is translated directly to the blade, thus pivoting the blade between its open and closed positions. Therefore, as button 206 is slid either towards the rear or the front of casing 202, blade 204 will pivot either into or out of casing 202, respectively.

It should once again be noted that while button 206 and shaft 226 slide along with gear 232, they do not rotate along with gear 232, thereby decreasing internal friction and permitting easy opening and closing of blade 206.

Once gear 232 engages either of the end teeth 218' and 218" on rack 218, blade 204 is nearly positioned in either of its terminal positions. To fully position blade 204 to its terminal positions it is necessary for the user to continue to longitudinally slide button 206 a slight distance in the appropriate direction (approximately 1/16 inch). In doing this, gear 232 becomes disengaged from end teeth 218', 218" and a pin 242 engages an appropriately positioned notch 244 or L-shaped notch 246. Pin 242 is attached to blade 204, and notches 244 and 246 are formed in casing 202 for receiving pin 242, and a detent cover 248 positioned in covering relation over detents 220 and 222. These are all completely analogous to the corresponding parts discussed in knives 10 and 100.

Referring now to FIGS. 17–21 there is seen a fourth alternate embodiment of a folding knife, denoted generally by reference numeral 300. As with the knives of the previously described embodiments, knife 300 is generally comprised of a casing 302, a blade 304 pivotally mounted for movement between closed and open positions with respect to casing 302, and a user activated button 306 slidably mounted to casing 302 for producing pivotal movement of blade 304 and translatory movement of pivot axis X—X.

Casing 302 is seen to include first and second opposed walls 308 and 310 having corresponding, axially aligned, longitudinally elongated, first and second slots 312 and 314 formed therethrough, respectively. Casing 302 further includes an open, blade receiving edge 315 a closed edge 317, and a curvilinear gear rack 319 (the end tooth nearest the butt of knife 300 are denoted 319') integrally formed between casing walls 308 and 310 adjacent closed edge 317. As seen most clearly in FIGS. 19 and 21, wall 310 includes two, laterally spaced apart, circular detent openings 320 and 322 cut out therefrom. Detent openings 320 and 322 are formed in intersecting relation with slot 314. As with the corresponding detent openings of the previously described embodiments, detent openings 320 and 322 are used to securely retain blade 304 in either of two positions.

Again in reference to the previously described embodiments, user actuated button 306 is fixedly attached to one end of an elongated shaft 324 which fully extends through a coiled spring 326, a flanged bushing 327, first slot 312, a cam-shaped gear 328 which is integrally formed into the tang portion 330 of blade 304, and second slot 314, again defining pivot axis X—X. Obviously, gear 328 and tang portion 330 have a common aperture 332 formed therethrough which permits for the passage of shaft 324. Bushing 327 includes a flanged portion which is positioned exteriorly adjacent to wall 308 and further includes a legged portion which extends downwardly through aperture 332 where it is attached to blade 304. Spring 326 is disposed, in a slightly compressed position, adjacently between button 306 and flanged bushing 327, thus creating an upward biasing force to button 306.

Shaft 324 further includes a flanged end 334 fixedly attached thereto and opposite button 306. Flanged end 334, as with all the previously described embodiments, provides the blade locking mechanism for knife 300.

Upon initiation of a downward and longitudinally applied user exerted force to button 306, flanged end 334 becomes disengaged from detent opening 320 or 322. Therefore, shaft 324, along with all parts connected thereto, slide within the confines of slot 312 in the direction of applied force. Due to shaft's 324 extension through gear 328, the sliding motion of shaft 324 is transferred directly to gear 328. As gear 328 slides in a longitudinal direction, its teeth cooperatively engage respective spaces formed between the teeth of gear rack 319, thereby imparting rotational motion thereto. Due to gear's 328 permanent attachment to blade 304, the simultaneous linear-rotational motion of the gear is translated directly to the blade and translated to axis X—X, thus pivotally moving the blade between its open and closed position. Therefore, as button 306 is slid either towards the front or the rear of casing 302, blade 304 will pivot either out of or into casing 302, respectively.

It should again be noted that while button 306 and shaft 324 slide along with gear 328, they do not rotate along with the gear, thereby decreasing internal friction of the moving parts and permitting easy opening and closing of blade 306.

Once gear 328 engages end tooth 319' on rack 319, blade 304 is nearly positioned in its terminally closed positions. To fully position blade 304 in its terminal, closed position, it is necessary for the user to continue to slide button 306 a slight distance in the appropriate direction (approximately 1/16 inch). In doing this, gear 328 becomes disengaged from end tooth 319' and a pin 336 engages an appropriately positioned J-shaped notch 340, respectively. Pin 336 and notch 340 are substantially identical to each of the pins and notches described in the previous embodiments.

Knife 300 also includes a blade lock cover 342. Cover 342 is fixedly attached to the outwardly facing surface of wall 310 in covering relation to slot 314 and detents 320 and 322. As in all previously described embodiments, cover 342 prevents foreign particles from accumulating within casing 302, thereby insuring the blade locking mechanism does not become jammed and unfunctionable.

Figures 22A, 22B, 22C:
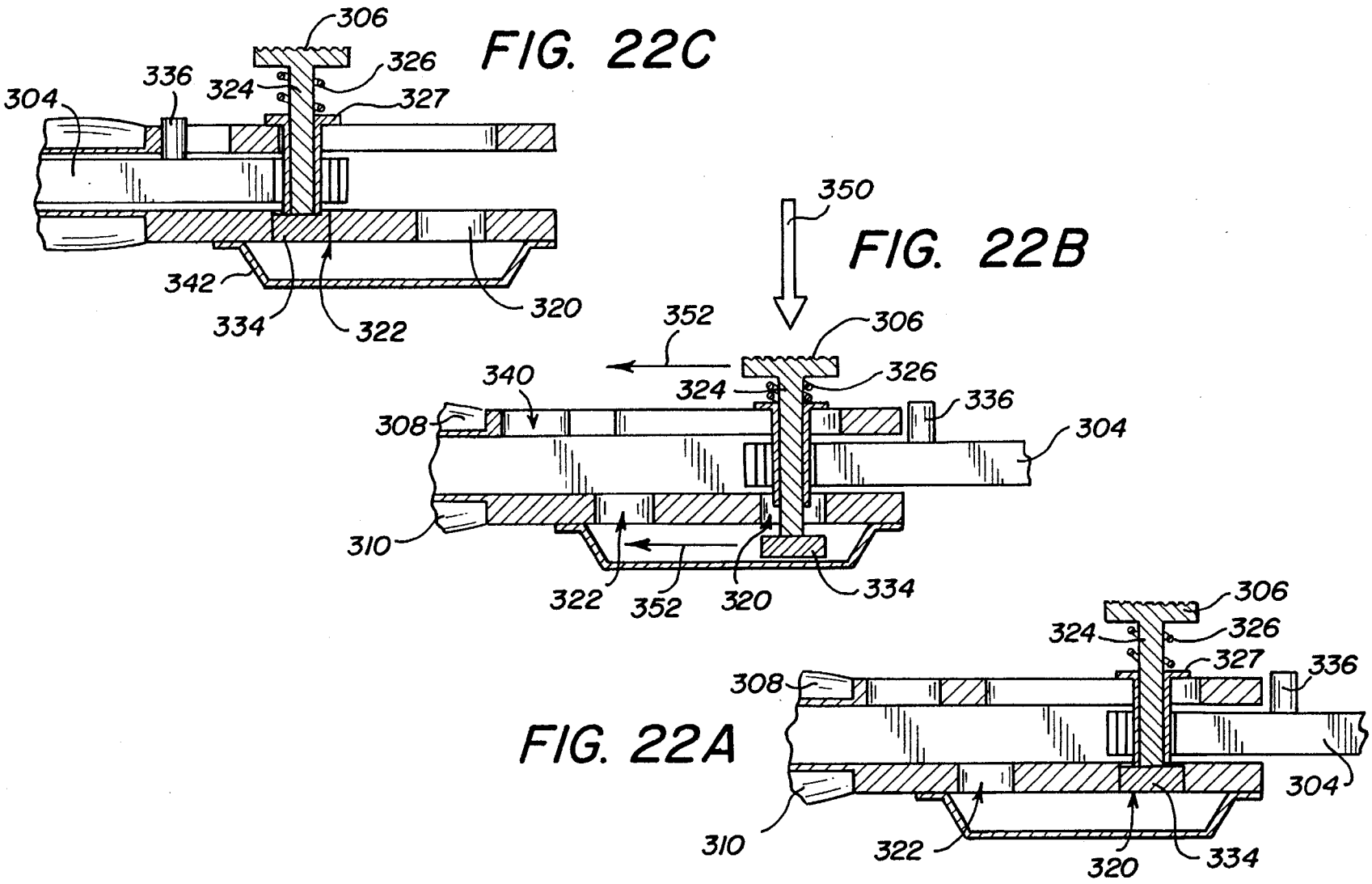
FIG. 22*a–c* are enlarged, fragmentary, cross-sectional views showing, in sequence, the blade movement operating principles used by the instant invention.

Referring now to FIGS. 22*a–c*, there is seen a sequence of events which effect pivotal movement of blade 304 (using the fourth embodiment of the present invention for illustrative purposes) between its closed and open positions.

In FIG. 22*a*, blade 304 is seen to be in its open positions. Flanged end 334 is securely positioned within detent opening 320 and spring 326 is a slightly compressed state.

FIG. 22*b* includes an arrow 350 representative of a user exerted force applied to button 306. Upon initiation of such a force, spring 326 is seen to become fully compressed and flanged end 334 disengages detent opening 320. Button 306, along with all its connected parts, is then slid in the direction represented by arrows 352.

Once blade 304 becomes fully closed, the user applied force to button 306 may be removed. Flanged end 334 engages detent opening 322 and pin 336 engages notch 340, thereby securely locking blade 304 in its closed position.

To move blade 304 back to its open position, it is necessary for a user to reverse the steps recited above.

FIGS. 22*a–c* were intended to represent the blade movement operating principles of each of the four disclosed embodiments. The reference numerals used were strictly for illustrative purposes only, and it should not be thought that only the knife disclosed in the fourth embodiment operates by the recited principles.

What is claimed is:

1. A folding knife comprising:

a) an elongated casing having first and second spaced, opposed walls defining an open space, said first and second walls having respective outwardly facing surfaces, a closed edge and a blade receiving edge;

b) a blade pivotally mounted to said casing and being operable between open and closed positions with respect thereto;

c) a plurality of spaced apart bosses fixedly protruding from said outwardly facing surface of said first wall;

d) a longitudinally slidable button mounted to said casing for actuation by a user of said knife; and e) means for pivotally moving said blade between said open and closed positions, said pivoting means being operatively attached to said blade and cooperatively positioned with respect to said plurality of bosses, whereby upon actuation of said button, said pivoting means translates said longitudinal sliding actuation into a rotational force, thereby effecting pivotal movement of said blade between said open and closed positions.

2. The folding knife according to claim 1 wherein said first and second walls of said casing include respective first and second longitudinally elongated slots co-linearly formed therethrough, said first and second slots being axially aligned with one another.

3. The folding knife according to claim 2 wherein said knife further includes a cover plate attached to said second wall in covering relation to said second slot.

4. The folding knife according to claim 2 wherein said plurality of bosses extend in a line parallel, and adjacent to said first longitudinal slot.

5. The folding knife according to claim 2 further including means for securely locking said blade in either of said open and closed positions.

6. The folding knife according to claim 5 wherein said second wall includes at least two, longitudinally spaced, substantially circular cutouts removed therefrom, said cutouts positioned in intersecting relation with said second slot.

7. The folding knife according to claim 6 wherein said blade includes tang and pointed portions, said tang portion positioned within said open space and including an aperture formed therethrough.

8. The folding knife according to claim 7 wherein said blade pivoting means includes:

a) a pawl positioned in abutting relation to said outwardly facing surface of said first wall, said pawl including a legged portion extending through said first slot and being fixedly attached to said blade about said aperture, said pawl further including a plurality of teeth which lie in meshingly engaging relation with said plurality of bosses; and b) means for rotating said pawl.

9. The folding knife according to claim 8 wherein said pawl rotating means includes:

a) an elongated shaft having first and second ends, said shaft fully extending through said first and second slots, said pawl, and said aperture;

b) said shaft further including a flange fixedly attached to said shaft's second end; wherein said shaft's first end is positioned exteriorly adjacent said first wall and said shaft's second end is positioned exteriorly adjacent said second wall; and c) spring means disposed about said shaft, said spring means being semi-compressed between said pawl and said button, whereby said spring means produces biasing forces to said button and said pawl, thereby urging said button away from said casing and urging said pawl toward said casing, thus urging said flange to securely engage one of said at least two cutouts formed in said second slot, thereby locking said blade in a predetermined orientation with respect to said casing.

10. The folding knife according to claim 1 wherein said bosses are circular in shape.

11. The folding knife according to claim 1 wherein said bosses are semi-circular in shape.

12. The folding knife according to claim 1 wherein said first and second casing walls respectively include first and second detents protruding outwardly from said respective outwardly facing surfaces.

13. The folding knife according to claim 12 wherein said first and second detents are axially aligned with one another.

14. The folding knife according to claim 13 further comprising handle means releasably attachable to said casing.

15. The folding knife according to claim 14 wherein said handle means include:

a) first and second walls held in spaced, parallel relation to one another, said first and second walls having respective inwardly facing surfaces;

b) first and second axially aligned apertures respectively formed through said handle first and second walls; and c) said handle first and second walls being operatively positioned in straddling relation to said casing first and second walls whereupon alignment of said first and second detents with said first and second apertures, said detents extend through said apertures, thereby securely attaching said handle means to said casing.

16. A folding knife comprising:

a) an elongated casing having first and second spaced, opposed walls defining an open space, said first and second walls having respective inwardly and outwardly facing surfaces;

b) a blade pivotally mounted to said casing and being operable between open and closed positions with respect thereto;

c) a button longitudinally slidably mounted to said casing for actuation by a user of said knife;

d) a longitudinal succession of a plurality of teeth fixedly attached to and extending in substantially co-planar relation with said first wall and said plurality of teeth being stationary with respect to said casing; and e) means for pivoting said blade between said open and closed positions, said pivoting means being operatively attached to said blade and cooperatively positioned with respect to said plurality of teeth, whereby upon actuation of said button, said pivoting means converts said user longitudinal sliding actuation into a rotational force, thereby effecting pivotal movement of said blade between said open and closed positions.

17. The folding knife according to claim 16 wherein said first and second walls of said casing include co-linearly extending respective first and second longitudinal slots formed therethrough, said first and second slots being laterally, axially, aligned to one another.

18. The folding knife according to claim 17 wherein said knife further includes a cover plate attached to said second wall in covering relation to said second slot.

19. The folding knife according to claim 17 wherein said plurality of teeth project into said first slot.

20. The folding knife according to claim 17 wherein said blade includes tang and pointed portions, said tang portion positioned within said open space and including an aperture formed therethrough.

21. The folding knife according to claim 20 wherein said blade pivoting means includes a) a gear having a central opening and being fixedly attached to said blade and positioned in meshingly engaging relation to said plurality of teeth with said central opening positioned in co-axial relation to said aperture;

b) a flanged bushing having a flanged portion which extends through said central opening and said aperture, and a bushing portion lying in abutting relation to said gear;

c) spring means positioned adjacently between said flanged bushing and said button; and d) an elongated shaft which extends through said aperture, said central opening, said flanged bushing, and said spring means, said shaft having a first end having a flange integrally attached thereto and a second end to which said button is attached, whereby upon actuation of said button, said gear engages said teeth, thereby effectively converting said longitudinal actuation into rotation, and said blade pivots in response thereto.

22. The folding knife according to claim 21 further including means for securely locking said blade in any one of said open and closed positions.

23. The folding knife according to claim 22 wherein said second wall includes at least two substantially circular cutouts removed therefrom, said cutouts being longitudinally spaced from one another and positioned in intersecting relation with said second slot.

24. The folding knife according to claim 23 wherein said spring means is semi-compressed between said gear and said button, whereby said spring means produces biasing forces to said button and said gear, thereby urging said button away from said casing and urging said gear toward said blade, thus effectively urging said first end of said shaft to securely engage one of said at least two cutouts, thereby locking said blade in a predetermined orientation with respect to said casing.

25. A folding knife comprising:

a) a casing having first and second spaced, opposed walls defining an open space, said first and second walls each having respective substantially planar, outwardly facing surfaces;

b) a blade pivotally mounted to said casing and being operable between open and closed positions with respect thereto;

c) means for pivotally moving said blade between said open and closed positions; and d) means for locking said blade in any one of said open and closed positions, said blade locking means including:

i) a first, elongated slot extending co-linearly through said first wall;

ii) at least two longitudinally spaced cutouts removed from said first wall, said cutouts positioned in intersecting relation with said slot; and iii) means for operatively engaging any one of said at least two cutouts, said cutout engaging means being operatively attached to said blade, whereby said cutout engaging means engages one of said at least two cutouts when said blade pivoting means positions said blade in one of said open and closed positions.

26. The folding knife according to claim 25 wherein said second wall includes a second, elongated slot formed therethrough and extending co-linearly therewith, said first and second elongated slots being axially aligned with one another.

27. The folding knife according to claim 26 wherein said blade includes a tang portion having an aperture formed therethrough, said tang portion being positioned in said open space defined in said casing.

28. The folding knife according to claim 27 wherein said blade pivoting means includes:

a) a user actuated button slidably mounted to said casing, said button being positioned adjacent said outwardly facing surface of said second wall; and b) gear means operatively connecting said button to said blade, whereby upon sliding actuation of said button, said gear means effectively cause pivoting of said blade between said open and closed positions.

29. The folding knife according to claim 28 wherein said cutout engaging means includes:

a) an elongated shaft extending through said first and second slots and said aperture, said shaft having first and second opposite ends respectively positioned adjacent said first and second wall's outwardly facing surface, said button being connected to said shaft second end;

b) spring means disposed about said shaft and positioned between said button and said second wall's outwardly facing surface, whereby said spring is in a semi-compressed state between said button and said gear means, thereby urging said button in a direction away from said casing and said gear means towards said blade; and c) a flange integrally attached to said shaft's first end, said flange shaped to cooperatively engage any one of said at least two cutouts, whereby said spring means urges said flange into engaging relation with any one of said at least two cutouts.

30. A folding knife comprising:

a) an elongated casing having first and second spaced, opposed walls defining an open space, said first and second walls having respective inwardly and outwardly facing surfaces, a closed edge and a blade receiving edge;

b) a blade pivotally mounted to said casing and being operable between open and closed positions with respect thereto;

c) a curvi-linear gear rack fixedly positioned within said open space, adjacent said closed edge, said gear rack having a plurality of teeth extending towards said blade receiving edge and said gear rack remaining stationary with respect to said casing;

d) a longitudinally slidable button mounted to said casing whereby a user of said knife may apply a longitudinal sliding force to said longitudinally slidable button; and e) means for pivotally moving said blade between said open and closed positions, said pivoting means being operably attached to said blade and cooperatively positioned with respect to said gear rack, whereby upon user actuation of said button, said pivoting means translates said longitudinal sliding force into a rotational force, thereby effecting pivotal movement of said blade between its said open and closed positions.

31. The folding knife according to claim 30 wherein said first and second walls of said casing include respective first and second longitudinally elongated slots co-linearly formed therethrough, said first and second slots being axially aligned with one another.

32. The folding knife according to claim 31 wherein said knife further includes a cover plate attached to said second wall in covering relation to said second slot.

33. The folding knife according to claim 31 further including means for securely locking said blade in either of said open and closed positions.

34. The folding knife according to claim 33 wherein said second wall includes at least two, longitudinally spaced, substantially circular detent openings formed therethrough, said detent openings positioned in intersecting relation with said second slot.

35. The folding knife according to claim 34 wherein said blade includes tang and pointed portions, said tang portion positioned within said open space and including an aperture formed therethrough.

36. The folding knife according to claim 35 wherein said blade pivoting means includes:

a) a geared pawl fixedly attached to said tang portion of said blade, said geared pawl having a hollow legged portion extending through said aperture formed through said second slot, said geared pawl further including a plurality of teeth which are positioned in meshingly engaging relation to said gear rack; and b) means for rotating said geared pawl.

37. The folding knife according to claim 36 wherein said pawl rotating means includes:

a) an elongated shaft having first and second ends, said shaft fully extending through said first and second slots, said pawl, and said aperture;

b) said shaft further including a flange fixedly attached to said shaft's second end; wherein said shaft's first end is positioned exteriorly adjacent said first wall and said shaft's second end is positioned exteriorly adjacent said second wall; and c) spring means disposed about said shaft, said spring means being semi-compressed between said pawl and said button, whereby said spring means produces biasing forces to said button and said pawl, thereby urging said button away from said casing and urging said pawl toward said casing, thus urging said flange to securely engage one of said at least two detent openings formed in said second slot, thereby locking said blade in a predetermined orientation with respect to said casing.

38. A folding knife comprising:

a) a casing including a pair of wall members having respective, opposed, inwardly-facing surfaces in spaced relation and respective, outwardly facing surfaces, said casing having a longitudinal axis;

b) a blade having a tang end and a distal end; and c) means for moving said blade with respect to said casing between a closed position, wherein at least a major portion of said blade is disposed between said inwardly-facing surfaces, and an open position, wherein said blade extends outwardly from said casing generally along said longitudinal axis, said moving means comprising:

i) a manually engageable member adjacent one of said outwardly facing surfaces;

ii) means defining a path of movement of said engageable member with respect to said casing between first and second terminal positions;

iii) means mounting said blade for pivotal movement about a pivot axis perpendicular to said longitudinal axis and extending through said tang end; and iv) means for transmitting movement of said engageable member along said path to combined translatory movement of said pivot axis and rotational movement of said blade about said pivot axis, said blade being in said closed and open positions when said engageable member is in said first and second terminal positions, respectively.

39. The folding knife according to claim 38 and further including first and second detent means for releasably retaining said engageable member in said first and second terminal positions, respectively.

40. The folding knife according to claim 39 wherein said engageable member is movable in a direction perpendicular to said path for release of said engageable member from said detent means.

41. The folding knife according to claim 38 and further including means for releasably locking said blade with respect to said casing in at least one of said closed and open positions.

42. The folding knife according to claim 38 and further including means for releasably locking said blade with respect to said casing in each of said closed and open positions.

43. The folding knife according to claim 38 wherein said path is substantially parallel to said longitudinal axis.

44. The folding knife according to claim 38 wherein said engageable member includes a stem portion and said path is defined by an elongated slot in at least one of said wall members through which said stem portion extends.

45. The folding knife according to claim 44 wherein said stem portion extends through an opening in said tang end coaxially with said pivot axis.

46. The folding knife according to claim 45 wherein said transmitting means includes a rotary toothed portion fixed with respect to said tang end and at least partially surrounding said pivot axis, and an engagement portion fixed with respect to said casing and positioned for engagement by said toothed portion during movement of said engageable member along said path, thereby producing rotation of said toothed portion and said blade.

47. The folding knife according to claim 46 wherein said engagement portion comprises a plurality of spaced bosses extending outwardly from one of said outwardly-facing surfaces.

48. The folding knife according to claim 46 wherein said engagement portion comprises a gear rack formed integrally with one of said wall members.

49. The folding knife according to claim 46 wherein said engagement portion comprises a succession of teeth mateable with said toothed portion and positioned between said wall members adjacent said tang end of said blade.

50. A folding knife comprising:

a) a casing including a pair of spaced wall members and having a longitudinal axis;

b) a blade having a tang end and a distal end; and c) means for effecting movement of said blade between closed and open positions with respect to said casing about a pivot axis extending through said tang end perpendicular to said longitudinal axis, said pivot axis being moveable relative to said casing as said blade moves about said pivot axis.

51. The folding knife according to claim 50 wherein said pivot axis extends through both said tang end and said pair of wall members in all positions of said pivot axis.

52. The folding knife according to claim 51 wherein said pivot axis is reciprocally moveable in directions generally parallel to said longitudinal axis.

53. The folding knife according to claim 51 and further including a member extending coaxially through said pivot axis and having a manually engageable portion to which force is applied to effect said blade movement.

54. The folding knife according to claim 53 wherein said member is moveable between first and second terminal positions to effect movement of said blade between said closed and open positions, respectively, and further including detent means for releasably maintaining said member in each of said terminal positions.

55. The folding knife according to claim 54 wherein said detent means are released by movement of said member along said pivot axis.

56. The folding knife according to claim 51 and further including means for releasably locking said blade in at least one of said closed and open positions.

57. The folding knife according to claim 56 wherein said locking means comprises a pin affixed to said blade and moveable into and out of engagement with a portion of said casing to effect locking and unlocking of said blade from said at least one position.

58. The folding knife according to claim 56 wherein said blade is locked in and unlocked from said at least one position by movement of said pivot axis in a direction substantially parallel to said longitudinal axis.

* * * * *